US009975234B2

(12) United States Patent
Berman

(10) Patent No.: US 9,975,234 B2
(45) Date of Patent: May 22, 2018

(54) POCKET HAND TOOL

(71) Applicant: True Brands Ltd, Poole (GB)

(72) Inventor: Lee Berman, Bournemouth (GB)

(73) Assignee: True Brands Limited, Poole (GB)

( * ) Notice: Subject to any disclaimer, the term of this patent is extended or adjusted under 35 U.S.C. 154(b) by 0 days. days.

(21) Appl. No.: 14/770,771

(22) PCT Filed: May 22, 2015

(86) PCT No.: PCT/EP2015/061477
§ 371 (c)(1),
(2) Date: Aug. 26, 2015

(87) PCT Pub. No.: WO2015/177371
PCT Pub. Date: Nov. 26, 2015

(65) Prior Publication Data

US 2017/0066118 A1 Mar. 9, 2017

(30) Foreign Application Priority Data

May 23, 2014 (GB) ..... 1409200.1

(51) Int. Cl.

| | |
|---|---|
| ***B25B 25/00*** | (2006.01) |
| ***B25F 1/00*** | (2006.01) |
| ***B25B 15/00*** | (2006.01) |
| ***B25F 1/04*** | (2006.01) |
| ***B25G 1/06*** | (2006.01) |
| *B26B 11/00* | (2006.01) |

(52) U.S. Cl.
CPC ..... *B25F 1/04* (2013.01); *B25F 1/00* (2013.01); *B25G 1/063* (2013.01); *B26B 11/00* (2013.01)

(58) Field of Classification Search
CPC ..... B25F 1/04; B25F 1/00; B25G 1/06; B25G 1/063; B26B 11/001
USPC ..... 7/107, 108, 118, 119, 165, 168, 170
See application file for complete search history.

(56) References Cited

U.S. PATENT DOCUMENTS

| | | | | |
|---|---|---|---|---|
| 849,891 | A * | 4/1907 | Ellingson | B25B 13/48 7/138 |
| 966,529 | A | 8/1910 | Cunningham | |
| 2,471,593 | A * | 5/1949 | Toye | B25B 13/56 7/168 |
| 3,321,783 | A * | 5/1967 | Ivan | B25F 1/04 16/422 |

(Continued)

FOREIGN PATENT DOCUMENTS

| | | |
|---|---|---|
| CN | 301342073 S | 9/2010 |
| CN | 301463212 S | 2/2011 |

(Continued)

*Primary Examiner* — Bryan R Muller
(74) *Attorney, Agent, or Firm* — Thorpe North & Western LLP

(57) ABSTRACT

A pocket hand tool having an elongate handle portion and a tool carrier plate rotatably mounted on the exterior of the elongate handle portion, the tool carrier plate having a peripheral array of tool heads, the tool carrier plate having a first rotary position in which the tool heads are in a stowed configuration and having one or more further rotary positions in which one or more of said tool heads are in a deployed configuration, said tool carrier plate having an exposed major surface portion which in use is capable of being manipulated by the thumb of the hand holding the elongate handle portion.

21 Claims, 2 Drawing Sheets

(56) References Cited

U.S. PATENT DOCUMENTS

| | | | | |
|---|---|---|---|---|
| 4,122,569 | A * | 10/1978 | Hitchcock | B25F 1/003 7/134 |
| 5,950,265 | A * | 9/1999 | Allen | B26B 11/001 30/153 |
| 6,142,769 | A | 11/2000 | Walker | |
| D515,903 | S | 2/2006 | Kelleghan | |
| D596,011 | S | 7/2009 | Almayda | |
| 7,665,389 | B2 * | 2/2010 | Frazer | B25F 1/04 7/128 |
| 8,533,880 | B1 * | 9/2013 | Stark | B25H 7/02 7/164 |
| D708,931 | S | 7/2014 | Petzl | |
| D709,344 | S * | 7/2014 | Adelman | B25B 15/00 D3/208 |
| D733,516 | S | 7/2015 | Kelleghan | |
| 9,339,940 | B2 | 5/2016 | Pelton | |
| D758,824 | S | 6/2016 | Kelleghan | |
| D768,460 | S | 10/2016 | Adelman et al. | |
| 2005/0144730 | A1 * | 7/2005 | Barber | B25B 7/22 7/138 |
| 2007/0277336 | A1 * | 12/2007 | Heaslet | A63C 11/08 15/105 |
| 2014/0259437 | A1 | 8/2014 | Leach et al. | |
| 2015/0197022 | A1 | 7/2015 | Pelton | |
| 2016/0167213 | A1 | 6/2016 | Adelman et al. | |

FOREIGN PATENT DOCUMENTS

| | | | |
|---|---|---|---|
| CN | 301481528 | S | 3/2011 |
| CN | 301481529 | S | 3/2011 |
| CN | 301957750 | S | 6/2012 |
| CN | 302840239 | S | 6/2014 |
| GB | 2152419 | A | 8/1985 |
| GB | 2472396 | A | 2/2011 |
| JP | D1308026 | | 8/2007 |
| WO | WO 03/074236 | A | 9/2003 |
| WO | WO DM070388-0003 | | 12/2008 |
| WO | WO 2013/019171 | A | 2/2013 |

* cited by examiner

POCKET HAND TOOL

BACKGROUND

The present invention relates to a pocket hand tool comprising a carrier having a peripheral array of tool heads.

A pocket hand tool is disclosed in WO 03074236A. This tool comprises a handle which carries a pivoted arm, the arm being foldable within the body of the tool. The arm carries a rotary tool carrier exposed on one face at its distal end. The rotary tool carrier carries a regular circular array of three screwdriver bits. The tool carrier can be rotated in steps of 120° under the control of a spring-loaded sliding detent mechanism to deploy selectively any one of the screwdriver bits. It is necessary to retract the spring-loaded slider (using, for example, a thumb of one hand) before rotating the tool carrier (using, for example, the fingers of the other hand). In each case the deployed screwdriver bit project forwardly from the distal end of the arm, parallel with its longitudinal axis. To stow all the screwdriver bits, it is necessary to fold the arm within the body of the tool. Accordingly, single-handed operation is not possible.

GB 2152419A discloses a screwdriver having a disc-shaped rotary bit carrier enclosed within a generally circular casing, the casing having an arcuate cut-out portion from which screwdriver bits can be selectively deployed. The screwdriver bits are disposed in a circular array. In one embodiment the rotary bit carrier has four screwdriver bits with an angle between two of the bits which is slightly great than the angle subtended by the arcuate cut-out portion, to allow a stowed configuration in which all the bits are enclosed within the casing. However it is not easy to rotate the bit carrier from the stowed orientation to a deployed orientation.

SUMMARY

In one aspect, the invention provides a pocket hand tool comprising an elongate handle portion and a tool carrier plate rotatably mounted on the elongate handle portion, the tool carrier plate having a peripheral array of tool heads, the tool carrier having a first rotary position in which the tool heads are in a stowed configuration and having one or more further rotary positions in which one or more of said tool heads are in a deployed configuration, said tool carrier plate having an exposed major surface portion which in use is manipulated by the thumb of the hand holding the elongate handle portion.

In this aspect it is preferred (though it is not essential) for the array of tool heads to be elongate. The exposed major surface portion of the tool carrier plate which can be manipulated by the user's thumb enables single-handed operation.

Preferably at least one of said tool heads has a longitudinal axis that intercepts a longitudinal axis of the tool carrier plate on the same side of the rotary axis of the tool carrier as said at least one tool head. This feature, which is illustrated by way of example in FIG. 3, enables a tool head to be deployed from one side of the tool with only a slight rotation of the tool carrier.

Preferably a detent defines indexed rotary positions of said tool carrier plate.

Preferably in one of said indexed rotary positions, one tool head is deployed on one of said sides and in another of said indexed rotary positions, more than one tool head is deployed on said one side. In some situations two tool heads are used and it is convenient not to have to manipulate the tool carrier to deploy them separately. In other situations only one tool head is used and it is convenient not to have to choose one of two or more deployed tool heads.

Preferably said elongate handle portion and tool carrier plate are rotatably connected by a two-part snap-fit or screwed bushing. This feature facilitates assembly during manufacture.

In another aspect the invention provides a pocket hand tool comprising an elongate handle portion having two opposite lateral sides and a tool carrier rotatably mounted on the elongate handle portion, the tool carrier having an elongate peripheral array of tool heads, the tool carrier having a first rotary position in which said elongate peripheral array is aligned with said elongate handle portion and the tool heads are in a stowed configuration and having one or more further rotary positions in which said elongate peripheral array is transverse to said elongate handle portion and one or more tool heads are in a deployed configuration, whereby said tool heads can protrude beyond both of said lateral sides.

The ability of the tool heads to protrude beyond both lateral sides (which includes the possibility of one or more tool heads protruding beyond one lateral side in one rotary position and one or more of the same or different tool head protruding beyond the other lateral side in another rotary position, as well as the preferred possibility wherein, in at least one of said further rotary positions, at least one tool head protrudes beyond one of said lateral sides and at least one other tool head protrudes beyond the opposite lateral side) increases the versatility of the tool and enhances ease of use.

Preferably said tool carrier is exposed on the outside of said elongate handle portion. This makes it easier to manipulate, for example, with the user's thumb.

Preferably said tool carrier and elongate handle portions are in the form of overlying substantially parallel plates and are pivoted about an axis of rotation substantially orthogonal to said plates. This resulting tool is flat and takes up little room in the user's pocket, and can be produced cheaply by forming two plates and then attaching them with a suitable bushing.

Preferably at least one of said tool heads has a longitudinal axis that intercepts a longitudinal axis of the tool carrier on the same side of the rotary axis of the tool carrier as said at least one tool head. This feature, which is illustrated by way of example in FIG. 3, enables a tool head to be deployed from one side of the tool with only a slightly rotation of the tool carrier.

Preferably said elongate peripheral array is substantially trapezoidal or parallelogram-shaped (most preferably, rectangular). It is convenient for the handle to have parallel sides and all the above arrays can fit within the periphery of a parallel-sided handle.

Preferably a detent defines indexed rotary positions of said tool carrier.

Preferably in one of said indexed rotary positions, one tool head is deployed on one of said sides and in another of said indexed rotary positions, more than one tool head is deployed on said one side. In some situations two tool heads are used and it is convenient not to have to manipulate the tool carrier to deploy them separately. In other situations only one tool head is used and it is convenient not to have to choose one of two or more deployed tool heads.

Preferably said elongate handle portion and tool carrier are rotatably connected by a two-part snap-fit or screwed bushing. This feature facilitates assembly during manufacture.

The following features are preferred in embodiments according to either aspect of the invention:

Preferably both ends of said elongate handle portion extend longitudinally beyond the boundary of said peripheral array of tool heads in the stowed configuration. This feature reduces the risk of a protruding tool head wearing or tearing a hole in a user's pocket.

Preferably both ends of said elongate handle portion extend longitudinally beyond the boundary of said peripheral array of tool heads in the deployed configuration. This feature enables both ends of the handle portion to be grasped easily by the user if necessary.

Preferably one or more tools are formed in said elongate handle portion. For example said tools may include one or more of a spanner, a serrated cutter, a file, a bottle cap remover, a miniature pry bar recess and a wire cutter.

Preferably said tool heads include one or more of a screwdriver bit, a wire stripper and a fingernail-cleaning projection.

In preferred embodiments, said elongate handle portion comprises a carabiner clip.

In such embodiments, preferably a stepped spanner portion is formed within the interior of said elongate handle portion adjacent said carabiner clip.

Preferably in said stowed configuration, said tool heads do not protrude beyond the outer periphery of said elongate handle portion when viewed in the direction of the axis of rotation of said tool carrier. This feature minimizes the risk of wear and tear to the user's pocket.

The preferred embodiment consists essentially of said elongate handle portion (optionally including a carabiner clip), said tool carrier and means for forming a rotary connection between them. Such an embodiment can be manufactured at low cost and is as versatile as more complicated tools.

BRIEF DESCRIPTION OF THE DRAWINGS

A preferred embodiment of the invention is described below by way of example only with reference to FIGS. 1 to 6 of the accompanying drawings, wherein.

DESCRIPTION

Figure 1:
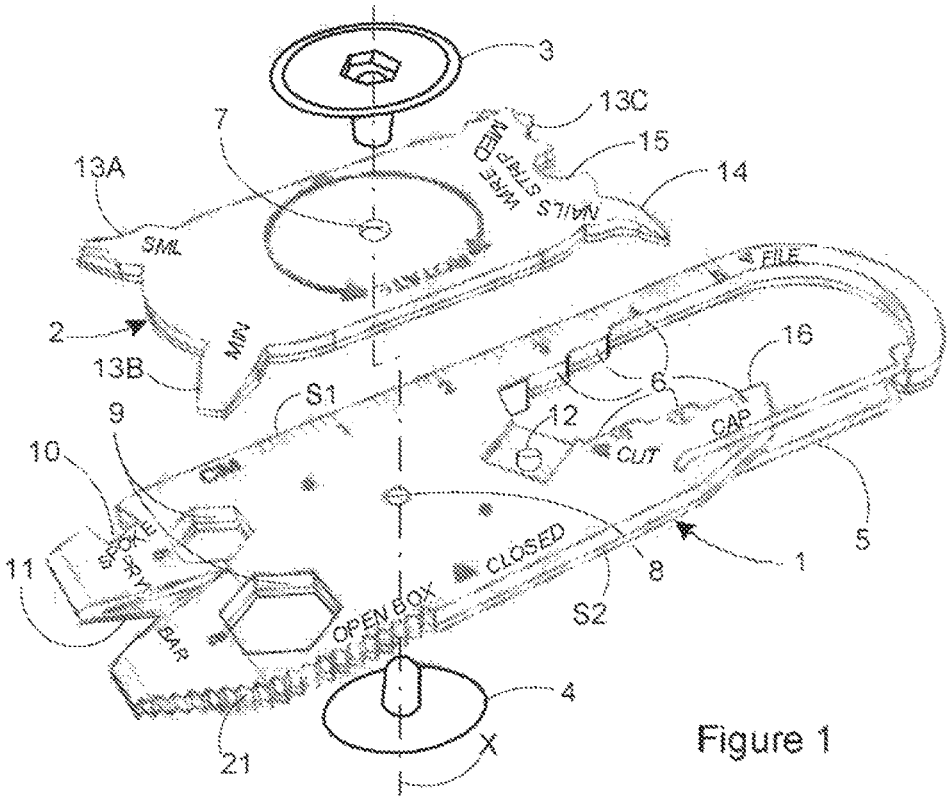
FIG. 1 is an exploded perspective view from above of a pocket tool in accordance with one embodiment of the invention.

Referring to FIG. 1 the pocket tool shown comprises an elongate handle portion 1, an elongate tool carrier plate 2, and snap-fit or screwed metal bushing assembly parts 3, 4 which fit through apertures 7 and 8 in tool carrier plate 2 and handle portion 1 respectively. In this manner the handle portion and tool carrier plate are pivotally connected for rotation about axis X.

Figure 2:
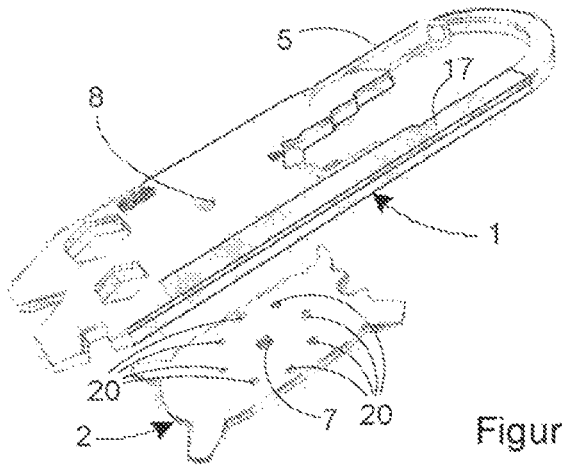
FIG. 2 is a disassembled perspective view from below of the tool carrier plate and handle portion of the pocket hand tool of FIG. 1.

The tool is provided with a detent mechanism comprising two diametrically opposite miniature spring-loaded ball plungers 22 on the upper face of handle portion 1 which engage respective detent recesses 20 (FIG. 2) disposed in a circular array in the underside of tool carrier plate 2. The detent mechanism defines eight indexed angular positions of the tool carrier plate on the handle portion, with an interval of 45° between them.

The tool carrier plate 2 is generally rectangular and has a rectangular array of tool heads at its corners, namely three screwdrivers heads 13A (small Phillips®), 13B (flat-bladed) and 13C (medium Phillips®) and a fingernail-cleaning tool 14, and also a wire stripper 15 cut-out portion formed in one of its shorter sides. These tools are labelled with indicia as shown.

Figure 3:
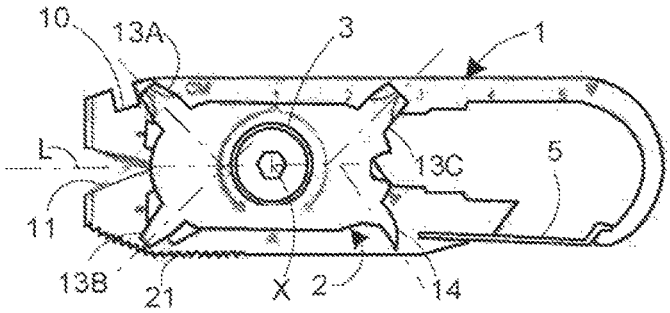
FIG. 3 is a top plan view of the pocket tool of FIGS. 1 and 2 in the retracted configuration.
Figure 5:
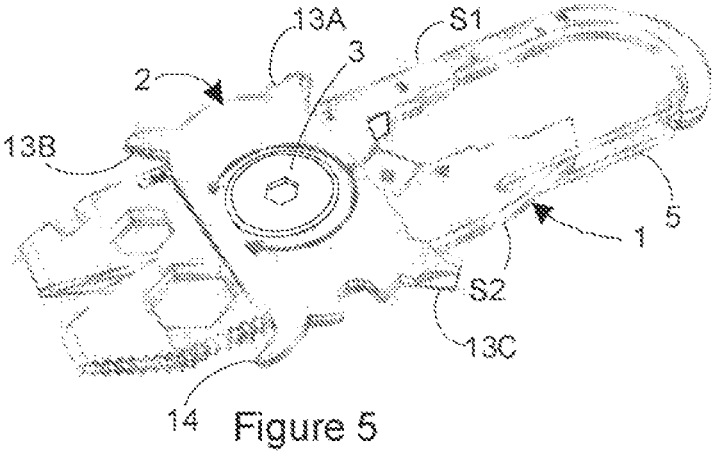
FIG. 5 is a perspective view of the pocket tool of FIGS. 1 and 2 in a second deployed configuration.
Figure 6:
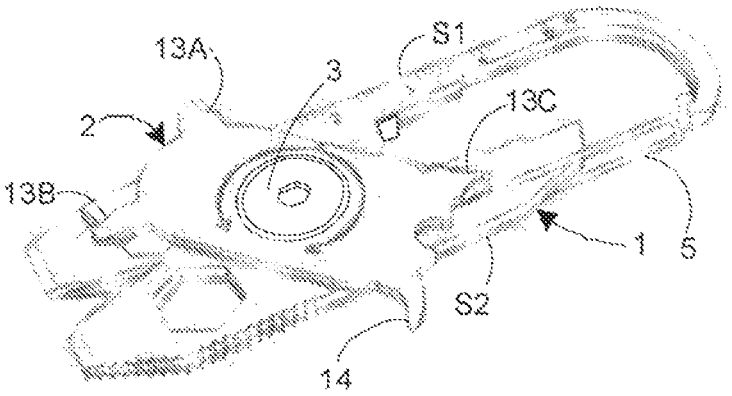
FIG. 6 is a perspective view of the pocket tool of FIGS. 1 and 2 in a third deployed configuration.

The elongate handle portion 1 includes a carabiner clip portion 5 and has opposed stepped spanner faces 6 of successively smaller spacing at the inner end of the internal periphery of the clip, terminating in a thread cutter/wire stripper blade 12 (labelled "CUT" on the handle portion 1 in FIG. 1). Thread cutter/wire stripper blade 12 is located in a square recess and its cutting edge projects slightly over the edge of the recess. When the tool carrier plate 2 is transverse to handle portion 1 (e.g., as shown in FIG. 5 or FIG. 6) the cutting edge is exposed and can be used to cut thread or the like. When the tool carrier plate is aligned with the handle portion 1 as shown in FIG. 3, semicircular cut-out portion 15 overlies the cutting edge of the blade 12 and the end of an insulated wire can be placed in the cut-out portion and rotated about its axis to make a cut in its insulation near its end. The cut length of insulation can then be pulled off. In this manner the blade 12, in conjunction with cut-out 15, functions as a wire-stripper.

It will be noted that the cutting edge of thread cutter/wire stripper blade 12, being located at the interior periphery of the tool, is not liable to cut a user's finger or a pocket in which the tool is kept. Cut-out 15 is too small for a finger. Furthermore, by rotating the tool plate 2 by 180° from the orientation shown in FIG. 3, the opposite end of the tool plate will completely cover the cutting edge.

In a variant the positions of the blade 12 and cut-out 15 can be interchanged, i.e., blade 12 can be located in a recess in tool carrier plate 2 and cut-out 15 can be formed in handle portion 1.

The handle portion 1 has a pry bar cut-out 11 formed in its forward (distal) end and a spoke spanner cut-out 11 formed at the forward end of its right-hand lateral side S1. The remainder of this side has a straight edge and corresponding ruler markings. The forward end of the left-hand lateral side S2 has a serrated box-cutting edge 21 formed therein. Finally, the handle portion 1 has hexagonal spanner apertures 9 formed at its forward end.

The stowed configuration of the tool is shown in FIG. 3, and it will be seen that the rectangular array of tool heads 13A-13C, 14 is longitudinally aligned with respect to the longitudinal axis L of handle portion 1. In this configuration, none of the tool heads protrude beyond the lateral sides of the handle portion 1.

Furthermore, the forward end and rear end of the handle portion 1 (to the left and right respectively in FIG. 3) both extend longitudinally beyond the boundary of said peripheral array of tool heads in the stowed configuration shown in this figure.

Furthermore, it will be noted that the axes of the forward tool heads 13A and 13B are disposed at 45° to and intersect longitudinal axis L at a point forward of rotary axis X and that the axes of rear tool heads 13C, 14 similarly intersect this axis L at points rearward of rotary axis X. This non-radial alignment of the tool head axes enables the tool heads to be deployed orthogonally with respect to the lateral sides S1 and S2 of handle portion 1 with an anticlockwise rotation of the tool carrier plate 2 of 45°, as shown in FIG. 4.

Figure 4:
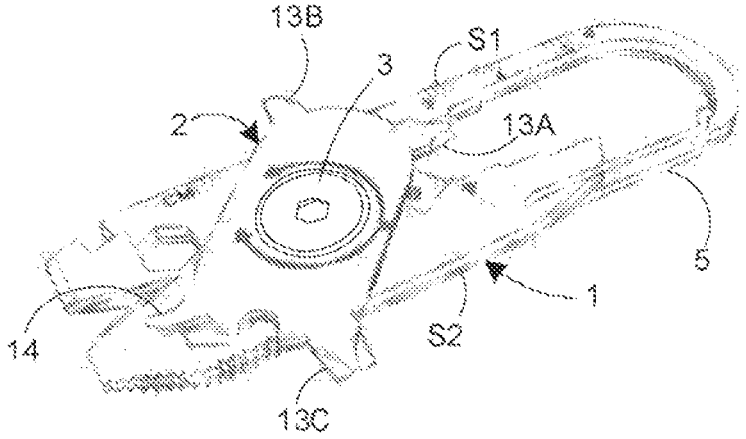
FIG. 4 is a perspective view of the pocket tool of FIGS. 1 and 2 in a first deployed configuration.

In the first deployed configuration shown in FIG. 4, the screwdriver heads 13B and 13C are deployed orthogonally from lateral sides S1 and S2 respectively.

As shown in FIG. 5, a further anticlockwise rotation of tool carrier plate 2 by 45° deploys all four tool heads from lateral sides S1 and S2, tool heads 13B and 14 projecting forwardly and tool heads 13A and 13C projecting rearwardly.

Finally, as shown in FIG. 6, a further anticlockwise rotation of tool carrier plate 2 by 45° deploys a tool head 13A orthogonally from lateral side S1 and deploys tool head 14 substantially orthogonally from lateral side S2.

Thus all four tool heads can be deployed singly or in combination, at an angle of either 45° or (approximately) 90° to lateral sides S1 and S2 of handle portion 1. The tool carrier plate 2, having a major surface exposed on handle portion 1, can easily be operated by the thumb of one hand while the fingers of that hand grasp the handle portion. Thus the tool is suited to a single-handed operation.

The invention claimed is:

1. A pocket hand tool comprising a planar elongate handle portion and a tool carrier plate rotatably mounted on a top exterior of the elongate handle portion, the tool carrier plate having a peripheral array of tool heads with at least three tool heads spaced from one another about the periphery of the tool carrier plate, the tool carrier plate having a first rotary position in which the tool heads are in a stowed configuration and having one or more further rotary positions in which one or more of said tool heads are in a deployed configuration with at least one tool head extending beyond the outer perimeter of the top distal exterior of the handle, said tool carrier plate having an exposed top surface portion which is capable of being manipulated by the thumb of a hand holding the elongate handle portion, wherein the tool carrier plate and all tool heads thereon are contained entirely within an outer perimeter of the elongate handle when in a stowed configuration and wherein the handle has at least one tool disposed thereon with at least one tool on the handle being at least partially covered by the carrier plate when in the stowed position.

2. The pocket hand tool according to claim 1, wherein at least one of said tool heads has a longitudinal axis that intersects a longitudinal axis of the tool carrier plate on the same side of the rotary axis of the tool carrier as said at least one tool head and wherein the tool carrier plate disposed about the top distal exterior of the elongate handle rotates 360 degrees.

3. The pocket hand tool according to claim 1, further comprising a detent defining indexed rotary positions of said tool carrier plate.

4. The pocket hand tool according to claim 3 wherein in one of said indexed rotary positions, one tool head is deployed on one of said sides and in another of said indexed rotary positions, more than one tool head is deployed on said one side.

5. The pocket hand tool according to claim 1, wherein said elongate handle portion and tool carrier plate are rotatably connected by a two-part snap-fit or screwed bushing.

6. A pocket hand tool according to any of claim 1 wherein the tool comprises a detent defining indexed rotary positions of said carrier tool plate in which said tool heads project orthogonally from opposite lateral sides of said elongate handle portion in a deployed configuration.

7. A pocket hand tool comprising an elongate handle portion having two opposite lateral sides and a tool carrier rotatably mounted on the elongate handle portion, the tool carrier being elongate and defined by opposed ends and opposed sides with at least one tool head extending from each opposed end and each opposed side, the tool carrier having a first rotary position in which said elongate peripheral array is aligned with said elongate handle portion and the tool heads are in a stowed configuration and having one or more further rotary positions in which said elongate peripheral array is transverse to said elongate handle portion and one or more tool heads are in a deployed configuration, whereby said tool heads can protrude beyond both of said lateral sides respectively, wherein the tool carrier plate and all tool heads thereon are contained entirely within an outer perimeter of the elongate handle when in a stowed configuration.

8. The pocket hand tool according to claim 7 wherein, in at least one of said further rotary positions, at least one tool head protrudes beyond one of said lateral sides and at least one other tool head protrudes beyond the opposite lateral side and wherein said tool carrier and elongate handle portions are in the form of overlying substantially parallel plates and are pivoted about an axis of rotation substantially orthogonal to said plates.

9. The pocket hand tool according to claim 7, wherein at least one of said tool heads has a longitudinal axis that intersects a longitudinal axis of the tool carrier on the same side of the rotary axis of the tool carrier as said at least one tool head.

10. The pocket hand tool according to claim 7, further comprising a detent defining indexed rotary positions of said tool carrier.

11. The pocket hand tool according to claim 10, wherein in one of said indexed rotary positions, one tool head is deployed on one of said sides and in another of said indexed rotary positions, more than one tool head is deployed on said one side.

12. The pocket hand tool according to claim 7, wherein both ends of said elongate handle portion extend longitudinally beyond the boundary of said peripheral array of tool heads in the stowed configuration.

13. The pocket hand tool according to claim 7, wherein both ends of said elongate handle portion extend longitudinally beyond the boundary of said peripheral array of tool heads in the deployed configuration.

14. The pocket hand tool according to claim 7, wherein one or more tools are formed in said elongate handle portion.

15. The pocket handle tool according to claim 14, wherein said tools include one or more of a spanner, a serrated cutter, a file, a bottle cap remover, a miniature pry bar recess, a thread cutter/wire stripper.

16. The pocket hand tool according to claim 14, further comprising a thread cutter and wire stripper formed by a blade carried on one of the handle portion and the tool carrier plate, and a cut-out formed in the other of the handle portion and the tool carrier plate, the blade having a cutting edge which is alignable with the cut-out portion.

17. A pocket hand tool, comprising:

an elongate handle having a top surface, a bottom surface, two opposite lateral sides, a proximal end, and a distal end, wherein the distal end of the elongate handle comprises a plurality of tools disposed thereon;

a planar tool carrier rotatably mounted on the top surface of the elongate handle, the tool carrier having an elongate peripheral array of tool heads, the tool carrier having a first rotary position in which the tool heads of the tool carrier are in a stowed configuration and having one or more further rotary positions in which one or more tool heads of the tool carrier are in a deployed configuration with at least one tool head extending beyond at least one lateral side of the handle, wherein when the tool carrier is in a stowed configuration one or more of the plurality of tools on the distal end of the elongate handle are at least partially covered by the tool carrier and one or more of the plurality of the tools on the distal end of the elongate handle are exposed and wherein the tool carrier plate and all tool heads thereon are contained entirely within an outer perimeter of the elongate handle when in the stowed position.

18. The pocket hand tool of claim 17, wherein all of the plurality of tools on the distal end of the elongate handle are exposed with the tool carrier in a deployed configuration.

19. The pocket hand tool of claim 17, wherein the tool heads of the tool carrier protrude beyond both of said lateral sides when the tool carrier is in a deployed configuration and are contained entirely within an outer perimeter of the elongate handle when in a stowed configuration.

20. The pocket hand tool of claim 17, wherein the tool carrier comprises first and second deployed configurations, wherein in a first deployed configuration a first plurality of the tool heads of the tool carrier protrude beyond opposing lateral sides of the elongate handle and a second deployment configuration wherein a second plurality of tool heads of the tool carrier protrude beyond opposing lateral sides of the elongate handle.

21. The pocket hand tool of claim 17, wherein one of the tools disposed about the distal end of the elongate handle comprises a blade with a wedge shaped void disposed about the center of the blade.

* * * * *